US007909045B2

(12) United States Patent
Rosenbauer et al.

(10) Patent No.: US 7,909,045 B2
(45) Date of Patent: Mar. 22, 2011

(54) ADDING DEVICE FOR DISHWASHERS FOR TABLET-TYPE DETERGENTS OR RINSING AGENTS AND DISHWASHER PROVIDED WITH SAID ADDING DEVICE

(75) Inventors: Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 791 days.

(21) Appl. No.: 11/794,521

(22) PCT Filed: Oct. 19, 2005

(86) PCT No.: PCT/EP2005/055366

§ 371 (c)(1),
(2), (4) Date: Jun. 28, 2007

(87) PCT Pub. No.: WO2006/072482

PCT Pub. Date: Jul. 13, 2006

(65) Prior Publication Data

US 2010/0000584 A1 Jan. 7, 2010

(30) Foreign Application Priority Data

Dec. 29, 2004 (DE) ..... 10 2004 063 276

(51) Int. Cl.
*B08B 3/02* (2006.01)

(52) U.S. Cl. ..... 134/93; 134/200

(58) Field of Classification Search ..... 68/17 R; 134/93

See application file for complete search history.

(56) References Cited

U.S. PATENT DOCUMENTS

| | | | | | |
|---|---|---|---|---|---|
| 2,254,269 | A | * | 9/1941 | Clark et al. | 134/57 D |
| 2,276,801 | A | * | 3/1942 | Stoddard | 134/93 |
| 2,624,352 | A | * | 1/1953 | Illian | 134/57 D |
| 2,689,576 | A | * | 9/1954 | Colstad | 134/58 DL |
| 2,771,894 | A | * | 11/1956 | Low | 134/57 R |
| 3,012,696 | A | * | 12/1961 | Kendt | 222/166 |
| 3,062,412 | A | * | 11/1962 | Cushing | 222/166 |
| 3,127,067 | A | * | 3/1964 | Hall | 222/630 |
| 3,160,319 | A | * | 12/1964 | Lengsfeld et al. | 222/54 |
| 3,608,514 | A | * | 9/1971 | Dunn | 116/228 |

(Continued)

FOREIGN PATENT DOCUMENTS

DE 6938272 U 6/1970

(Continued)

OTHER PUBLICATIONS

European Patent Office 0 858 768 Aug. 1998.*

(Continued)

*Primary Examiner* — Frankie L Stinson
(74) *Attorney, Agent, or Firm* — James E. Howard; Andre Pallapies

(57) ABSTRACT

An adding device for dishwashers includes a fillable supply chamber for receiving a tablet-type detergent or rinsing agent. The supply chamber is arranged and configured in such a way that, when the adding device is in an operational position in the dishwasher, the detergent or rinsing agent can escape from the supply chamber into the rinsing area in a non-impeded manner in the direction of gravity. As a result, no substantial detergent residues remain in the supply chamber after the cleaning or rinsing program has come to an end. This results in the addition of cleaner into the dishwasher in an improved, reliable manner.

14 Claims, 3 Drawing Sheets

U.S. PATENT DOCUMENTS

Figure 1:
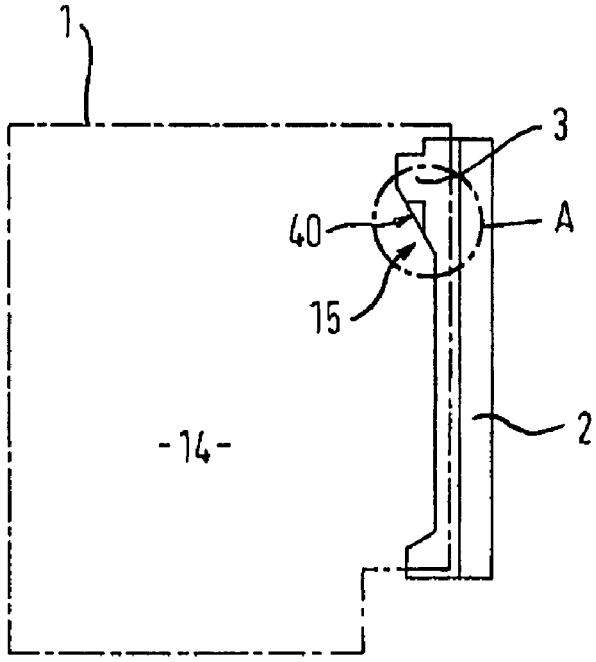

| | | | | | |
|---|---|---|---|---|---|
| 3,858,854 | A | * | 1/1975 | Win et al. | 510/392 |
| 4,984,596 | A | * | 1/1991 | Westfelt | 134/58 DL |
| 5,005,740 | A | * | 4/1991 | Marks et al. | 222/651 |
| 5,115,822 | A | | 5/1992 | Nichols | |
| 5,133,892 | A | * | 7/1992 | Chun et al. | 510/224 |
| 5,884,821 | A | | 3/1999 | Wilhelmstaetter et al. | |
| 5,958,855 | A | * | 9/1999 | Binstock et al. | 510/224 |
| 7,063,092 | B2 | * | 6/2006 | Cerruti | 134/93 |
| 2003/0054971 | A1 | * | 3/2003 | Robinson et al. | 510/446 |

FOREIGN PATENT DOCUMENTS

| | | | |
|---|---|---|---|
| DE | 35 13 640 | * | 10/1986 |
| EP | 0 858 768 | | 8/1998 |
| EP | 1 281 346 | | 2/2003 |
| EP | 1 374 754 | | 1/2004 |
| GB | 1 357 818 | * | 6/1974 |
| JP | 11-000300 | * | 1/1999 |
| JP | 2002-000538 | * | 1/2002 |
| JP | 2002-065565 | * | 3/2002 |
| WO | WO 03/045214 | | 6/2003 |
| WO | WO 2004/021854 | | 3/2004 |

OTHER PUBLICATIONS

European Patent Office 1 281 346 Feb. 2003.*
International Search Report PCT/EP2005/055366.

* cited by examiner

ADDING DEVICE FOR DISHWASHERS FOR TABLET-TYPE DETERGENTS OR RINSING AGENTS AND DISHWASHER PROVIDED WITH SAID ADDING DEVICE

The present invention relates to an adding device for dishwashers, especially for tablet-type detergents or rinsing agents comprising a fillable supply chamber for receiving especially a tablet-type detergent or rinsing agent, as well as a dishwasher provided with said adding device.

With known adding devices for dishwashers for adding detergents or rinsing agents for example the required amount of a powder-type or tablet-type detergent can be added before the start of a washing program in a supply chamber provided for this purpose of a dispensing compartment with the door of the device open. After the adding device has been filled with detergent or rinsing agent and the flap covering the supply chamber has been closed manually, after the device door has been closed, the detergent or rising agent in the supply chamber falls down into the wash area of the dishwasher when the flap covering the supply chamber is opened. In such cases current supply chambers for receiving detergents are mostly embodied so as to be primarily designed for the chamber hollows to be flushed through with water, in order to flush the detergent or rinsing agent completely out of the supply chamber. This can be done for example using a specific embodiment of the spray arms or an overhead shower unit of the dishwasher or indirectly using rinsing water flowing over it.

With these types of adding devices for dishwashers it can occur that the supply chambers are not completely rinsed out during the course of the washing and/or rinsing program because of the formation of spray shadows by the dishes or such like. This means that dampened remains of detergents remain in the supply chambers after the end of the program. It is further possible for incorrect filling of the upper basket of the dishwasher for a cover of a supply chamber mechanism to be opened by a flap mechanism to only be able to partly open, especially if hinging movement of the cover is impeded for example by a protruding part of the dishes, such as handles of cups of such like. This can lead to the cover only partly opening with the result that the supply chamber of the adding device is only partly accessible from within the wash area. In such a case in particular there is the danger of the supply chamber not being flushed out completely during the course of a washing and/or rinsing program as a result of inadequate rinsing-through of the chamber hollows.

If a tablet-type detergent or rinsing aid is used as a detergent or rinsing agent the problem can especially occur of an incompletely open cover of the supply chamber not allowing the dishwasher tablet to pass unhindered into the wash area for example because the opening between chamber wall and cover is smaller than the dimensions of the dishwasher tablet. The problem thus arises of undissolved residue of dishwasher tablets remaining in the supply chamber after the washing or rinsing program have finished.

A dishwasher is described in DE 69 38 272 in which an adding device receiving the detergent is built into a front door, said device featuring an adding opening with a cover. The adding device has a fully open shell-type housing in relation to the wash area of the dishwasher on the section of which facing the floor of the dishwasher a cover is supported horizontally. A spring is built into the support point which attempts to open the cover the crockery basket of the dishwasher is assigned to the cover of the adding device as a stop which allows the cover to hinge from its closed position into its open position by around 30°. With this type of arrangement of the above-mentioned problem with bad loading of the crockery basket can occur.

The object underlying of the present invention is to embody an adding device for dishwashers with a fillable supply chamber for receiving detergents or rinsing agents especially in the form of a tablet so that, after the end of a washing and/or rinsing program, as little detergent residue as possible remains in the supply chamber. It is also the object of the present invention to specify a corresponding dishwasher.

The object is achieved by an adding device for dishwashers according to the features of claim 1 as well as by a dishwasher according to the features of claim 12.

The supply chamber of the inventive adding device for dishwashers, which can especially be filled with tablet-type detergent or rinsing agent, is arranged and formed so that in the operating position of the adding device in the dishwasher the detergent or rinsing agent can escape unimpeded in the direction of gravity into the wash area from the supply chamber. In particular the supply chamber is mounted in or on a dishwasher door which closes off the wash area from outside or is an integral component of such a door. The supply chamber forming a detergent hollow is preferably arranged on the inner side of the door and embodied so that, in the operating position, when the door is closed, the especially tablet-type detergent or rinsing agent can escape almost horizontally into the wash area of the dishwasher.

An improved and more reliable addition of detergent in the device is achieved in this way. The fact that in the operating position of the adding device in the dishwasher the detergent or rinsing agent can escape impeded in the direction of gravity in to the wash area or from the supply chamber enables the situation to be especially prevented in which the dishwasher tablet is impeded by badly placed dishes to the side in the exit from the supply chamber since the dishwasher table can escape in the direction of gravity. It is only necessary to ensure that no obstacle is placed directly below the supply chamber which can prevent the dishwasher tablet from coming out.

The advantages described are produced equally for powder-type detergent or rinsing agents as well, since no dishwasher powder or only very little, which then has to be flushed out in the subsequent washing or rinsing program, remains in the supply chamber as a result of the unimpeded exit in the direction of gravity.

In a preferred embodiment of the invention the adding device is geometrically formed and arranged so that the detergent or rinsing agent falls as a result of its gravitational force in a straight line and unimpeded into the wash area. An optimum reliable addition of detergent in the device can thus be achieved.

In accordance with an advantageous embodiment of the invention the adding device its geometrically formed and arranged so that a hollow is formed in the filling position of the supply chamber to receive the detergent or rinsing agent. The supply chamber is preferably embodied in or on the door of a dishwasher, with, in the operating position of the adding device, a plane along which the door inner-side opening of the supply chamber runs being inclined in the direction of the wash area. This makes it possible that in the filling position of the supply chamber a dishwasher tablet is received into the hollow and subsequently in the operating position of the adding device, as a result of the inclined opening plane of the supply chamber, falls in a straight line and unimpeded into the wash area.

Preferably the supply chamber is arranged in or on the dishwasher door in a transition of the inner side of the door between a control panel area and another area of the door. The control panel area of a dishwasher is especially characterized by the fact that, as a result of the arrangement of electronic modules and switches, it generally requires a greater door depth by comparison with the remaining area of the dishwasher door. With the placing of the supply chamber in the transition between operating panel of the door and its lower area, the supply chamber can be arranged so that the above-mentioned inclined opening plane in the supply chamber is produced so that dishwasher tablet can fall as a result of its gravitational force in a straight line and unimpeded into the wash area.

An especially advantageous embodiment makes provision for the supply chamber to be arranged in or on the dishwasher door so that, when the door is open and with a wash basket of the dishwasher which is pulled out fully so that it can be filled, the supply chamber is not fully or partly covered by the wash basket in the direction of filling the supply chamber. In accordance with this embodiment the hollow of the supply chamber, before receiving the detergent or rinsing agent, is thus positioned outside the wash basket withdrawal with the dishwasher door open so that there is unimpeded access to the supply chamber for filling purposes. In addition such a placement of the supply chamber prevents the danger of contamination of the supply chamber during the loading process of the dishwasher.

In another embodiment a wash basket of the dishwasher, especially a lower basket of the dishwasher, is embodied so that with the door open and with a completely pulled out wash basket the supply chamber is not completely or partly covered by the wash basket in the direction of filling up the supply chamber. For example the length of the washing basket is adapted in accordance with the circumstances or has corresponding cut-outs or other geometrical designs so that it does not cover the supply chamber in its filling position in the direction of filling. This means that in the same way liquid contaminated residues from dishes which are loaded in the dishwasher are prevented from being able to drip into the supply chamber for example.

Further advantageous embodiments and developments of the invention are specified in the subclaims.

Figure 2:
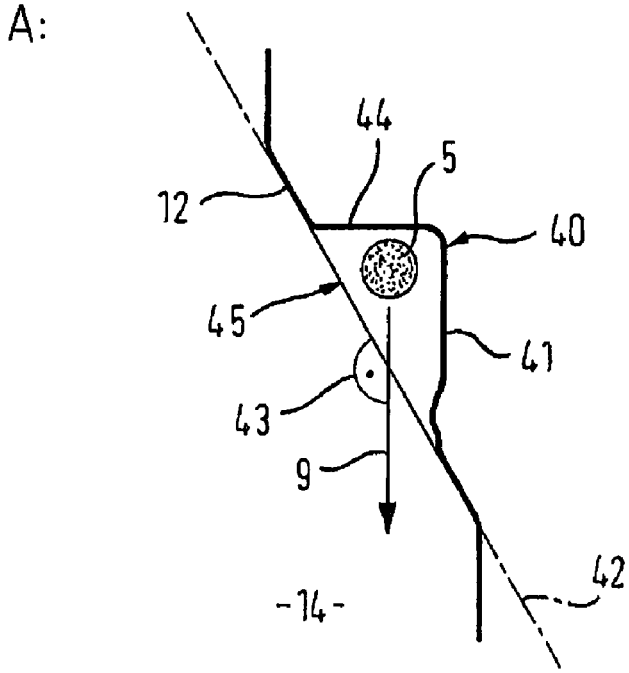
Figure 3:
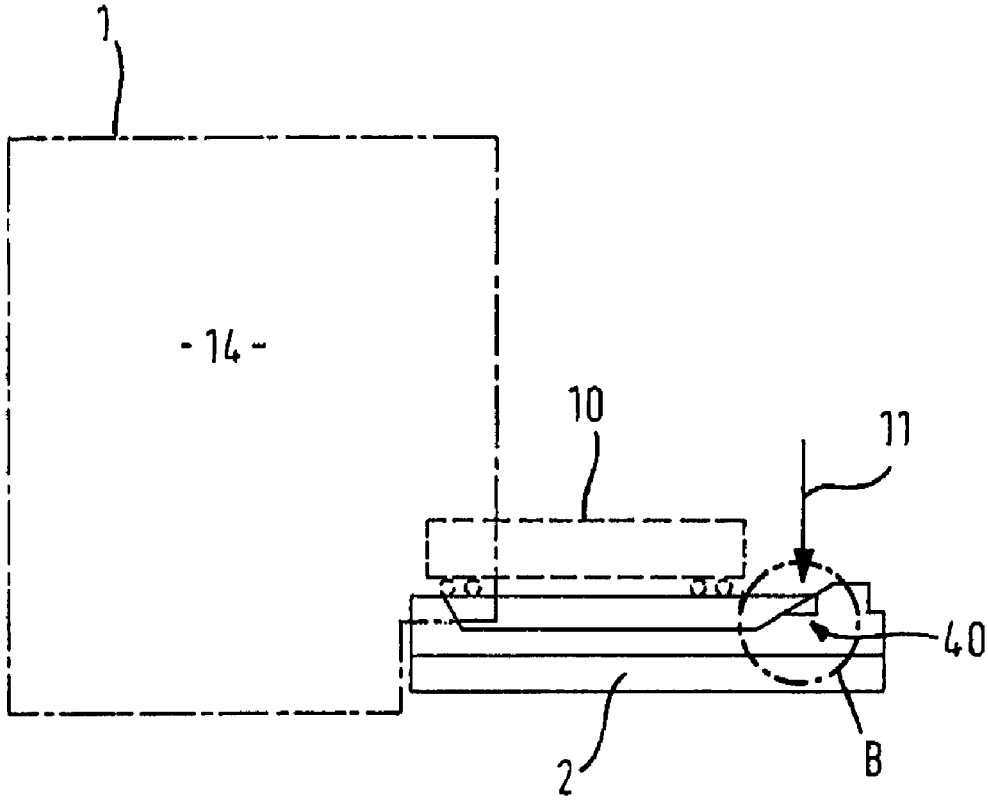
Figure 4:
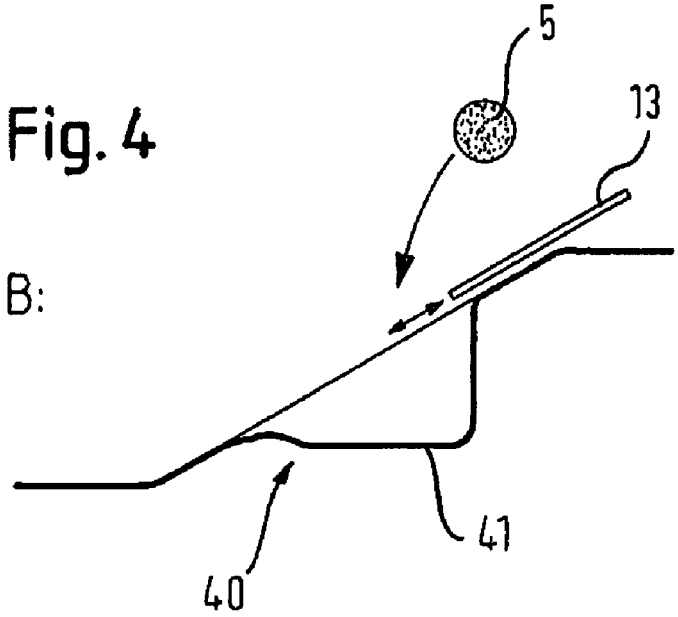
Figure 5:
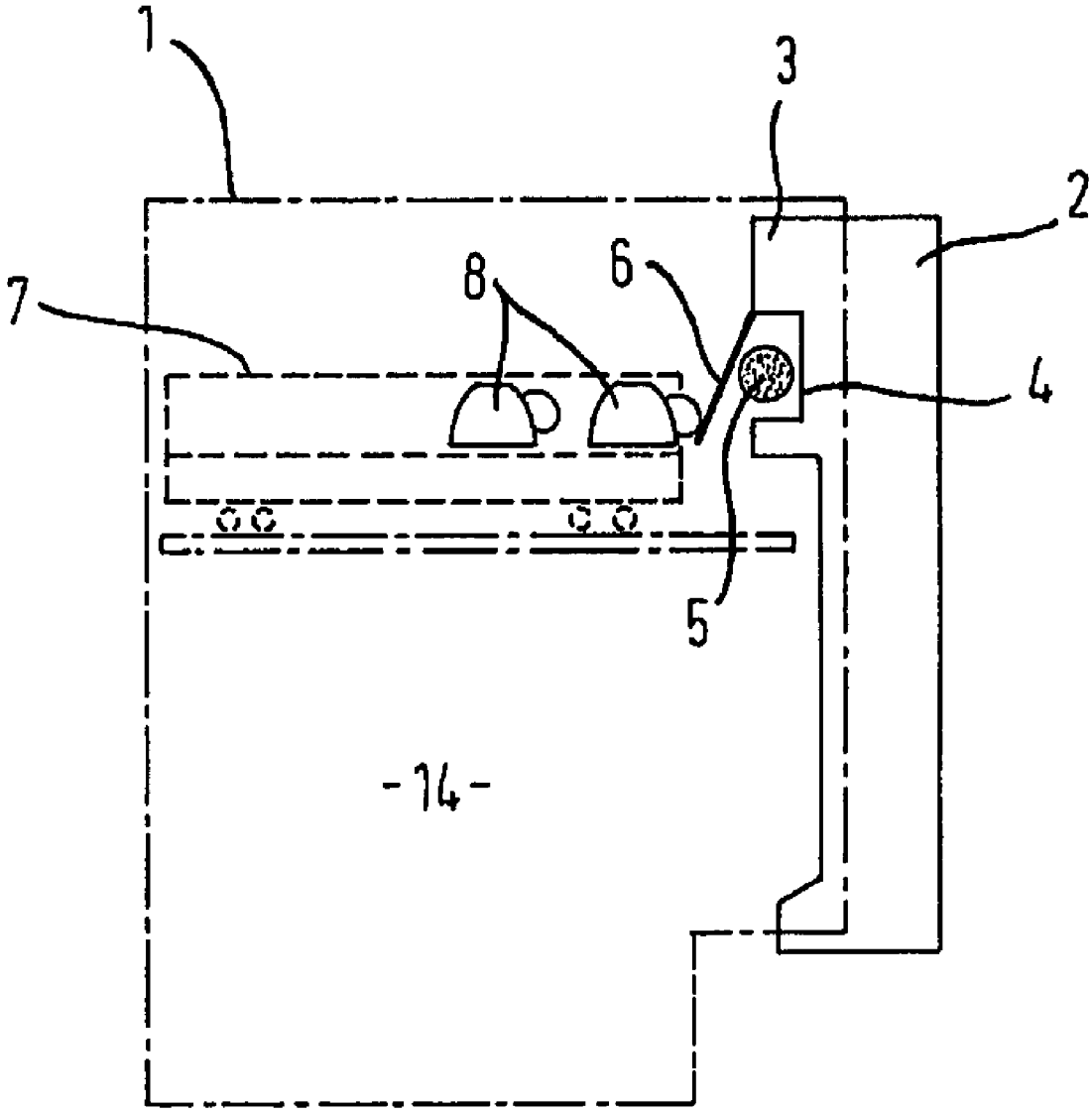
Fig. 5 Prior Art

The invention is explained by examples in greater detail below with reference to the figures shown in the drawing. The figures show:

FIG. 1 a side view of a dishwasher with an embodiment of an inventive adding device in the operating position of the dishwasher, FIG. 2 a detailed view of the inventive adding device of the dishwasher shown in FIG. 1, FIG. 3 a side view of a dishwasher with an embodiment of an inventive adding device in the filling position, FIG. 4 a detailed view of the inventive adding device of the dishwasher shown in FIG. 3, FIG. 5 a side view of a dishwasher with an adding device according to the prior art.

FIG. 5 shows a side view of a dishwasher 1 with a device for adding detergent or rinsing agent, which is arranged in the control panel area 3 of the dishwasher door 2. A supply chamber with an essentially rectangular cross-section has a cover 6 which can be actuated by a flap mechanism which can be lifted to allow the supply chamber 4 to be filled with detergent or rinsing agent. After the filling of the supply chamber 4 for example with a dishwasher tablet 5 the flap cover 6 is closed and the supply chamber 4 thereby sealed. A wash basket 7 in the form of an upper basket is loaded for a subsequent washing and/or rinsing process in the dishwasher 1 with dishes 8, for example in the form of cups, and is pushed into the wash area 14 of the dishwasher. Subsequently the dishwasher door 2 is closed and a corresponding switch for selecting and starting a washing and/or rinsing program, which is arranged in the control panel area 3 of the door 2, is actuated. In a "wash" program section the cover 6 in the rinsing area 14 is opened by a control signal of the program control unit, so that the dishwasher tablet 5 can escape into the wash area 14.

In accordance with the diagram shown in FIG. 5 however the dishes 8 in the form of the cup arranged furthest forward are badly positioned so that the flap can only partly swing open. The result is that an opening is produced between internal wall of the supply chamber 4 and cover 6 which is not large enough to allow the dishwasher tablet 5 to escape unimpeded into the wash area 14. This means that the dishwasher tablet 5 remains in the supply chamber 4 so that it is merely wetted by rinsing water which gets into the opening between supply chamber 4 and cover 6. This produces the relatively great danger that, as the washing or rinsing program progresses, the supply chamber 4 or the dishwasher tablet 5 will not be completely flushed out, i.e., that wetted detergent remains will be left in the supply chamber 4 after the end of the program.

FIG. 1 shows a side view of a dishwasher 1 with an embodiment of an inventive adding device 40 in the operating setting of the dishwasher. FIG. 2 here shows a detailed view of the inventive adding device of the dishwasher depicted in FIG. 1 in a cross-section A. The adding device 40 has a supply chamber 41 able to be filled with detergent or rinsing agent, which in the present exemplary embodiment especially accommodates a tablet-type detergent or rinsing agent 5. The supply chamber 41 is mounted in the door 2 of the dishwasher, which seals the wash area 14 from the outside or is an integral component of the door. It is especially arranged in the transition 15 of the inside of the door between the control panel area 3 arranged in the door 2 and the remaining lower area of the door 2. In this case the control panel area 3 is characterized by a greater depth or thickness by comparison with the lower part of the door 2, which is caused especially by the arrangement of electronic components, switches and suchlike for operating the dishwasher 1.

The adding device 40, which is formed by the supply chamber 41 and the surrounding part of the inner wall 12 of the door 2, is geometrically formed and arranged so that in the operating position (closed door 2) of the adding device free access is provided from the upper supply chamber wall 44 by the dishwasher tablet 5 to the wash area 14 in the gravitational direction 9. This means that in the operating position of the adding device 40 the dishwasher tablet 5 can escape almost unimpeded in the gravitational direction 9 into the wash area 14 from the supply chamber 41. In particular the input device 40 is geometrically formed and arranged so that the dishwasher tablet 5, as a result of its gravitational force, falls in a straight line and unimpeded in the direction of gravity 9 into the wash area 14.

A hollow is formed in the door 2 by the supply chamber 41 in order to accommodate detergent or rinsing agent. In this case the opening 45 of the supply chamber 41 inside the door runs along a plane 42, which coincides with the inner wall 12 surrounding the supply chamber 41. This plane 42, along which the door inner side opening 45 of the supply chamber 41 runs, is inclined in the direction of the wash area 14. In this case the plane 42 forms an obtuse angle 43 with the direction of gravity 9. With this arrangement it is made possible especially advantageously for the dishwasher tablet 5 to fall as a result of its gravitational force in a straight line and unimpeded into the wash area 14. This means that the dishwasher tablet 5 can reliably reach into the interior of the wash area 14 and be wetted unimpeded by rinsing water, so that the detergent, for example in tablet or powder form or also as gel/fluid, is reliably dissolved.

FIG. 3 shows a side view of a dishwasher with an embodiment of an inventive input device in the filling position. In this case FIG. 4 shows a detailed view of the inventive adding device of the dishwasher depicted in FIG. 3 (cross section B). The dishwasher 1 is in its filling position, in which both the wash basket 10 (lower basket) can be loaded with dishes and also the input device 40 with the supply chamber 41 can be provided with detergent or rinsing agent. The lower basket 10 can be pulled out from the wash area 14 so that it can be filled with dishes, with the lower basket 10 being moved out on rollers along the inside of the door 2 so that there is good access to the wash basket from outside for loading it with dishes. In the diagram depicted in FIG. 3 the wash basket 10 is shown in its completely pulled-out position, with the supply chamber 41 not being fully or partly covered by the wash basket 10 in the direction of filling 11. This means that the hollow of the supply chamber 41 is located outside the area of the door 2 which is covered by the wash basket 10. In this case this placement reduces the danger of contamination of the supply chamber during the process of loading the dishwasher with dirty dishes.

With reference to FIG. 4 it can further be seen that the inventively embodied adding device 40 has a cover 13 with which the supply chamber 41 is able to be closed. The cover 13 can be pushed along the inside of the door 2 preferably in the plane 42 (FIG. 2) of the dishwasher. A flap cover (not shown) is also possible. During the washing or rinsing program the cover 13 opens so that the interior of the supply chamber 41 is released and the dishwasher tablet 5, as depicted in FIGS. 1 and 2 can fall in a straight line and unimpeded into the wash area 14. Compared to the embodiment of an adding device as depicted in FIG. 5, this embodiment has the advantage of the opening movement of the cover not being able to be impeded by badly-placed dishes. This means that a reliable addition of detergent which is independent of the loading process of the dishwasher is made possible.

List of Reference Symbols

1 Dishwasher
2 Door
3 Control panel area
4 Supply chamber
5 Dishwasher tablet
6 Cover
7 Wash basket
8 Dishes
9 Direction of gravity
10 Wash basket
11 Direction of filling
12 Inner wall
13 Cover
14 Wash area
15 Transition
40 Adding device
41 Supply chamber
42 Plane
43 Angle
44 Upper supply chamber inner wall
45 Opening of the supply chamber

The invention claimed is:

1. An adding device for adding into a dishwasher an agent that assists an operation of the dishwasher, the adding device comprising:

a supply chamber for receiving an agent that assists an operation of a dishwasher, the supply chamber permitting an agent received therein to exit from the supply chamber and thereafter enter a wash area in which items to be handled by the dishwasher are disposed, and the adding device being disposable between a filling disposition in which a fill quantity of an agent can be filled into the supply chamber, with the fill quantity of the agent being that quantity of the agent that comprises a complete number of doses of the agent to be administered during a respective dishwasher operation, and an operating disposition in which no structure prevents substantially the fill quantity of the agent from exiting the supply chamber in a full release manner with none of the agent being subjected to any intervening stoppages as the agent exits the supply chamber, the agent that has been released from the supply chamber having a direction of movement once it is beyond the supply chamber in the direction of gravity.

2. The adding device as claimed in claim 1 wherein the supply chamber is mounted at a selected one of in a door of the dishwasher and on a door of the dishwasher, the door of the dishwasher closing off the wash area from outside.

3. The adding device as claimed in claim 2, wherein, in the operating disposition of the adding device, a plane along which a door inner-side opening of the supply chamber runs, is inclined in the direction of the wash area.

4. The adding device as claimed in claim 3, wherein the plane along which the door inner-side opening of the supply chamber runs forms an obtuse angle with the direction of gravity.

5. The adding device as claimed in claim 2, wherein the supply chamber is arranged in a transition of the door inner side between a control panel area arranged in the door and another area of the door.

6. The adding device as claimed in claim 2, wherein the supply chamber is arranged such that, when the door is open and the wash basket of the dishwasher is pulled out completely so that it can be filled, the supply chamber is not covered in any manner by the wash basket in the direction of filling of the supply chamber.

7. The adding device as claimed in claim 1 wherein the adding device is geometrically formed and arranged so that, in the operating disposition of the adding device, free access from an upper supply chamber inner wall into the wash area in the direction of gravity is possible.

8. The adding device as claimed in claim 1 wherein the adding device is geometrically formed and arranged so that the detergent or rinsing agent, as a result of its gravitational force, falls in a straight line and unimpeded into the wash area.

9. The adding device as claimed in claim 1, wherein the adding device is geometrically formed and arranged so that, in the operating disposition of the supply chamber, a hollow is formed for accommodating the detergent or rinsing agent.

10. The adding device as claimed in claim 1, wherein the supply chamber is able to be closed by a cover.

11. The adding device as claimed in claim 10, wherein the cover is embodied and arranged so as to be able to be moved along the inner side of a door of the dishwasher which closes off the wash area from the outside.

12. A dishwasher, comprising:

a wash area in which items to be handled by the dishwasher are disposed; and an adding device for adding into the dishwasher an agent that assists an operation of the dishwasher, the adding device including a supply chamber for receiving an agent that assists an operation of a dishwasher, the supply chamber permitting an agent received therein to exit from the supply chamber and thereafter enter the wash area in which items to be handled by the dishwasher are disposed, and the adding device being disposable between a filling disposition in which a fill quantity of an agent can be filled into the supply chamber, with the fill quantity of the agent being that quantity of the agent that comprises a complete number of doses of the agent to be administered during a respective dishwasher operation, and an operating disposition in which no structure prevents substantially the fill quantity of the agent from exiting the supply chamber in a full release manner with none of the agent being subjected to any intervening stoppages as the agent exits the supply chamber, the agent that has been released from the supply chamber having a direction of movement once it is beyond the supply chamber in the direction of gravity.

13. The dishwasher as claimed in claim 12, wherein the supply chamber is mounted at a selected one of in a door of the dishwasher and on a door of the dishwasher, the door of the dishwasher closing off the wash area from outside, the dishwasher includes a wash basket of the dishwasher that can be moved out of the wash area to fill it, the supply chamber of the adding device is arranged such that, when the door is in an opened state and with the wash basket fully moved-out, the supply chamber is not covered in any manner by the wash basket in the direction of filling of the supply chamber.

14. The dishwasher as claimed in claim 12, wherein the supply chamber is mounted at a selected one of in a door of the dishwasher and on a door of the dishwasher, the door of the dishwasher closing off the wash area from outside, the dishwasher includes a wash basket of the dishwasher that can be moved out of the wash area to fill it, the supply chamber of the adding device is arranged such that, when the door is in an opened state and with the wash basket fully moved-out, the supply chamber is not partly covered by the wash basket in the direction of filling of the supply chamber.

* * * * *